US007790981B2

(12) United States Patent
Vaupotic et al.

(10) Patent No.: US 7,790,981 B2
(45) Date of Patent: Sep. 7, 2010

(54) SHIELDED PARALLEL CABLE

(75) Inventors: Gregory Vaupotic, Wallingford, CT (US); Timothy Tassmer, Wallingford, CT (US); Carl Booth, Storrs, CT (US)

(73) Assignee: Amphenol Corporation, Wallingford, CT (US)

( * ) Notice: Subject to any disclaimer, the term of this patent is extended or adjusted under 35 U.S.C. 154(b) by 844 days.

(21) Appl. No.: 10/937,429

(22) Filed: Sep. 10, 2004

(65) Prior Publication Data

US 2006/0054334 A1 Mar. 16, 2006

(51) Int. Cl.
*H01B 11/00* (2006.01)
*H01B 11/02* (2006.01)

(52) U.S. Cl. ..... 174/36; 174/113 R; 174/120 R

(58) Field of Classification Search ..... 174/36, 174/113 R, 105 R, 107, 120 R, 108, 109, 174/117 F See application file for complete search history.

(56) References Cited

U.S. PATENT DOCUMENTS

| | | | | |
|---|---|---|---|---|
| 4,319,940 | A * | 3/1982 | Arroyo et al. | 156/56 |
| 4,327,246 | A | 4/1982 | Kincaid | |
| 4,488,125 | A | 12/1984 | Gentry et al. | |
| 4,596,897 | A | 6/1986 | Gruhn | |
| 4,746,767 | A | 5/1988 | Gruhn | |
| 4,767,890 | A | 8/1988 | Magnan | |
| 5,008,489 | A | 4/1991 | Weeks, Jr. et al. | |
| 5,142,100 | A * | 8/1992 | Vaupotic | 174/24 |
| 5,293,146 | A * | 3/1994 | Aosaki et al. | 336/206 |
| 5,414,213 | A | 5/1995 | Hillburn | |
| 5,483,020 | A | 1/1996 | Hardie et al. | |
| 5,956,445 | A | 9/1999 | Deitz, Sr. et al. | |
| 6,255,594 | B1 * | 7/2001 | Hudson | 174/121 A |
| 6,261,683 | B1 | 7/2001 | Tanaka | |
| 6,462,268 | B1 | 10/2002 | Hazy et al. | |
| 6,531,658 | B2 | 3/2003 | Tanaka et al. | |
| 6,566,606 | B1 * | 5/2003 | Hazy et al. | 174/113 R |
| 6,677,518 | B2 | 1/2004 | Hirakawa et al. | |
| 6,677,534 | B2 | 1/2004 | Yamamoto et al. | |

FOREIGN PATENT DOCUMENTS

| | | |
|---|---|---|
| CN | 2282724 Y | 5/1998 |

* cited by examiner

*Primary Examiner*—Chau N Nguyen
(74) *Attorney, Agent, or Firm*—Blank Rome LLP

(57) ABSTRACT

The cable of the present invention contains at least one pair of insulated conductors and an optional drain wire. The insulate conductors and drain wire is longitudinally covered in a shielding tape, which preferably comprises a metallic sheet having an adhesive applied on selected portions of a surface of the metallic sheet. The adhesive is preferably applied in a checker board pattern so that the surface having adhesive thereon contains areas of uncoated, exposed metal forming contact pads. The shielding tape is then covered with two layers of polymeric tapes in opposite helical directions. The polymeric tape is preferably constructed of a polymeric sheet having a layer of adhesive disposed on a surface thereof. In a preferred embodiment, the tapes are wrapped around the shielding tape in opposite directions such that the adhesive surfaces face each other. The tapes are then optionally covered with a jacket.

36 Claims, 9 Drawing Sheets

SHIELDED PARALLEL CABLE

FIELD OF THE INVENTION

The present invention relates to shielded electric cables for the transmission of electrical signals through the cables. In particular, the present invention provides improved shielded parallel pair cables for achieving low insertion loss performance and method of making the cables.

BACKGROUND OF THE INVENTION

Electrical cables for data transmission are well known. One common cable is a coaxial cable. Coaxial cables generally comprise an electrically conductive wire surrounded by an insulator. The wire and insulator are surrounded by a shield, and the wire, insulator and shield are surrounded by a jacket. Coaxial cables are widely used and best known for cable television signal transmission and ethernet standard communications in local area networks. Coaxial cables can transmit at much higher frequencies than a standard twisted pair wire and, therefore, have a much greater transmission capacity. In addition, coaxial cables have very little crosstalk, and therefore, provide a very reliable medium for data transmission. Other types of cables are also well known, such as twisted pair cables used for telephone signal transmission, and fiber optic cables.

With the proliferation of high-speed, powerful personal computers and the availability of advanced telecommunications equipment, there is a need for cables which are capable of transmitting data at ever faster speeds. Fiber optic cables provide optimum data rate and performance for long distance and high data rate transmissions, since fiber optic cables provide very high data rate transmission with low attenuation and virtually no noise. Fiber optic cables provide data transmission at data rates up to and beyond 10 Gbps. However, despite the increased availability of fiber optic cables, the price of fiber optic cables and transceivers have not dropped to a level where it is always practicable to use. Accordingly, other less expensive cables capable of high speed data transmission are still in demand.

One such cable used for high speed data transmission between two points or devices is a shielded parallel pair cable. Parallel pair cable designs provide two separately insulated conductors arranged side by side in parallel relation, the pair being then helically wrapped in a shield. However, a helically applied shield has many discontinuities. The signal path within the shield is interrupted each time the signal encounters an overlap in the spiral. These repeated interruptions cause signal loss, measured as increased attenuation. A common usage of these cables is to interconnect a mainframe computer to a memory device. As is well known, the speed and data rate with which the computer must communicate with the memory is critical to the computer's performance capabilities. Parallel pair cables are usually used for differential signal transmission. In differential signal transmission, two conductors are used for each data signal transmitted and the information conveyed is represented as the difference in voltage between the two conductors.

U.S. Pat. No. 6,677,518 to Hirakawa et al. discloses a data transmission cable having a pair of conductors, each coated with an insulation, and a drain wire. The pair of conductors and drain wire are successively covered by a shielding tape, which can be longitudinally or spirally wrapped, having a thickness of between 1 μm and 10 μm; and a resin layer. There is no disclosure of polymeric tape layers intermediate to the shielding tape and resin layer.

U.S. Pat. No. 5,483,020 to Hardie et al. discloses parallel pair cable having a pair of conductors, each covered with an insulation to electrically insulate the conductors from each other. The insulated conductors are then covered with a metal shield, preferably constructed of a plurality of interwoven electrically conductive strands to prevent radiated energy from escaping the cable construction. The shield is surrounded by a jacket to protect the cable. There is no disclosure of polymeric tape layers intermediate to the shielding tape and resin layer or of a drain wire.

Even with recent advances in parallel cable construction, there remains a need for a high speed parallel pair cable that reduces skew and also minimizes the pair shield discontinuities in order to achieve low insertion loss performance.

SUMMARY OF THE INVENTION

The present invention relates to shielded electric cables for the transmission of electrical signals through the cables. In particular, the present invention provides an improved shielded parallel pair cables for achieving low insertion loss performance.

The cable of the present invention contains at least one pair of insulated conductors and an optional drain wire. The insulated conductors are laid parallel to one another, forming a common axis. The insulated conductors and drain wire are longitudinally covered by a shielding tape, which preferably comprises a metallic sheet having an adhesive applied on selected portions of its surface. The adhesive is most preferably applied in a checker board pattern so that the surface contains areas of uncoated, exposed metal forming contact pads. The shielding tape is then covered with two layers of polymeric tapes spirally wrapped around the shielding tape in opposite helical directions. The polymeric tape is preferably constructed of a polymeric sheet having a layer of adhesive disposed on one surface.

Methods of making the cable are also disclosed. In an embodiment the cable is made by providing a core having a pair of insulated conductors and a drain wire, wrapping a shielding tape longitudinally around the core, successively wrapping two layers of polymeric tapes around the shielding tape in opposite helical directions. Preferably, the shielding tape comprises a metallic sheet having an adhesive applied in a checker-board pattern on its surface.

BRIEF DESCRIPTION OF THE DRAWINGS

The foregoing background and summary, as well as the following detailed description of the drawings, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE PREFERRED EMBODIMENT

Figure 1:
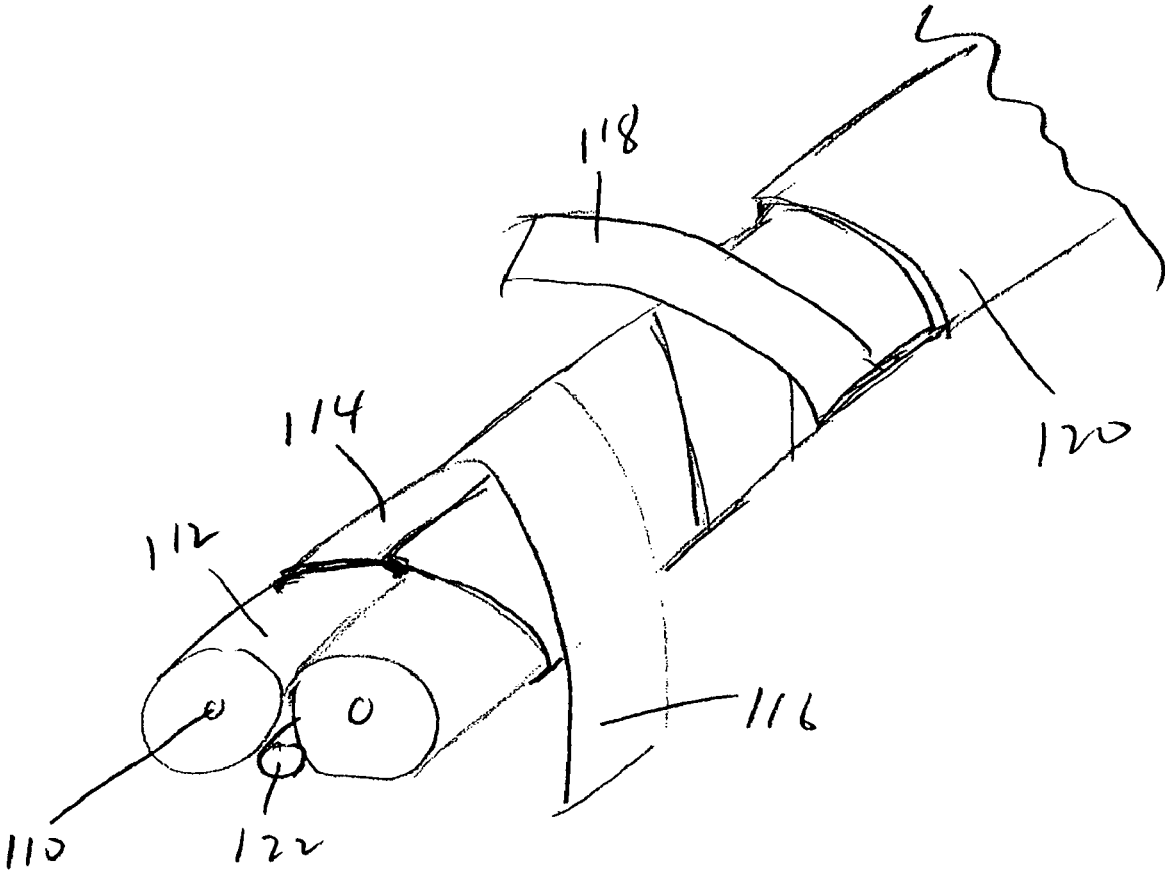
FIG. 1 shows a three dimensional view of an embodiment of the present invention.
Figure 2:
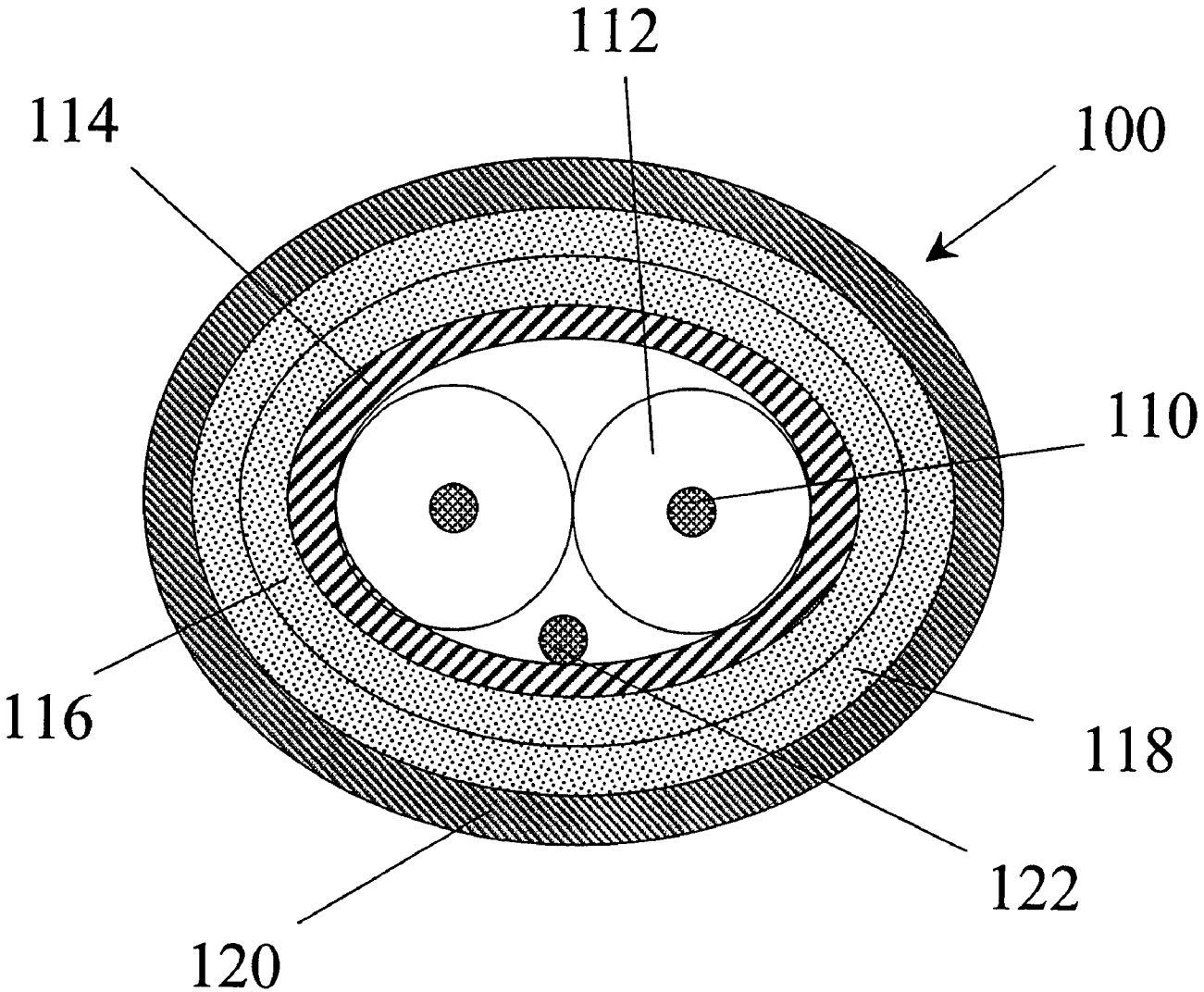
FIG. 2 shows a cross-sectional view of an embodiment of the present invention.

As shown in FIGS. 1 and 2, the data transmission cable 100 according to the present invention is shown as a differential data transmission cable having at least a pair of conductors 110. Here, FIG. 1 is a plan view showing the overall configuration of a first embodiment of the data transmission cable according to the present invention, while FIG. 2 is a view showing the cross-sectional structure of the cable.

In this embodiment, each of the conductors 110 is coated with an insulation 112, such as a plastic material. The outer periphery of the insulation 112 is successively covered with a shielding tape 114, two layers of polymeric tapes 116 and 118, and a jacket 120 as an optional component.

In a preferred embodiment, a grounding drain wire 122 is also provided along the insulated conductors 110, so as to be contained inside the shielding tape 114 together with the conductors 110. The conductors 110 (coated with the insulation 112) and the drain wire 122 constitute the core of the cable. The position of the drain wire 122 is not confined as shown in FIGS. 1 and 2. The drain wire 122 may be located in a horizontal position so as to be adjacent to or in between the conductors 110 like a flat ribbon tape structure. Various drain wire positions are known in the art and could be used in the present invention.

Various methods can be considered for covering the conductors 110 (coated with the insulation 112) with the shielding tape 114. Preferably, the conductors 110 may be longitudinally wrapped with the shielding tape 114 such that both ends of the shield tape 114 overlap each other along the longitudinal direction of the conductors 110, as shown in FIG. 1. This is referred to herein as a "longitudinal wrap."

When the data transmission cables according to the present invention are differential data transmission cables, at least a pair of conductors contained inside the cable 100 are located in a state parallel to each other.

The conductors 110 are composed of a single wire conductor formed of, for example, a soft copper wire, a tin-plated soft copper wire, a silver-plated copper alloy wire, and the like or of a stranded wire conductor made by stranding the single wires. Other metal materials, such as aluminum, steel, and the like that are commonly used in making conductors for cables, are appropriate for the present invention. The preferred conductor material is silver plated copper.

The insulation 112 is preferably composed of a polymeric material which can be, but is not limited to, polyethylene, polypropylene, copolymer of ethylene and tetrafluoroethylene (ETFE), copolymer of tetrafluoroethylene and hexafluiropropylene (FEP), polytetrafluoroethylene (PTFE) resin, copolymer of tetrafluoroethylene and perfluoroalkoxy (PFA), fluorine-containing rubber, or mixtures thereof. The preferred insulation material is polyethylene.

Figure 3A:
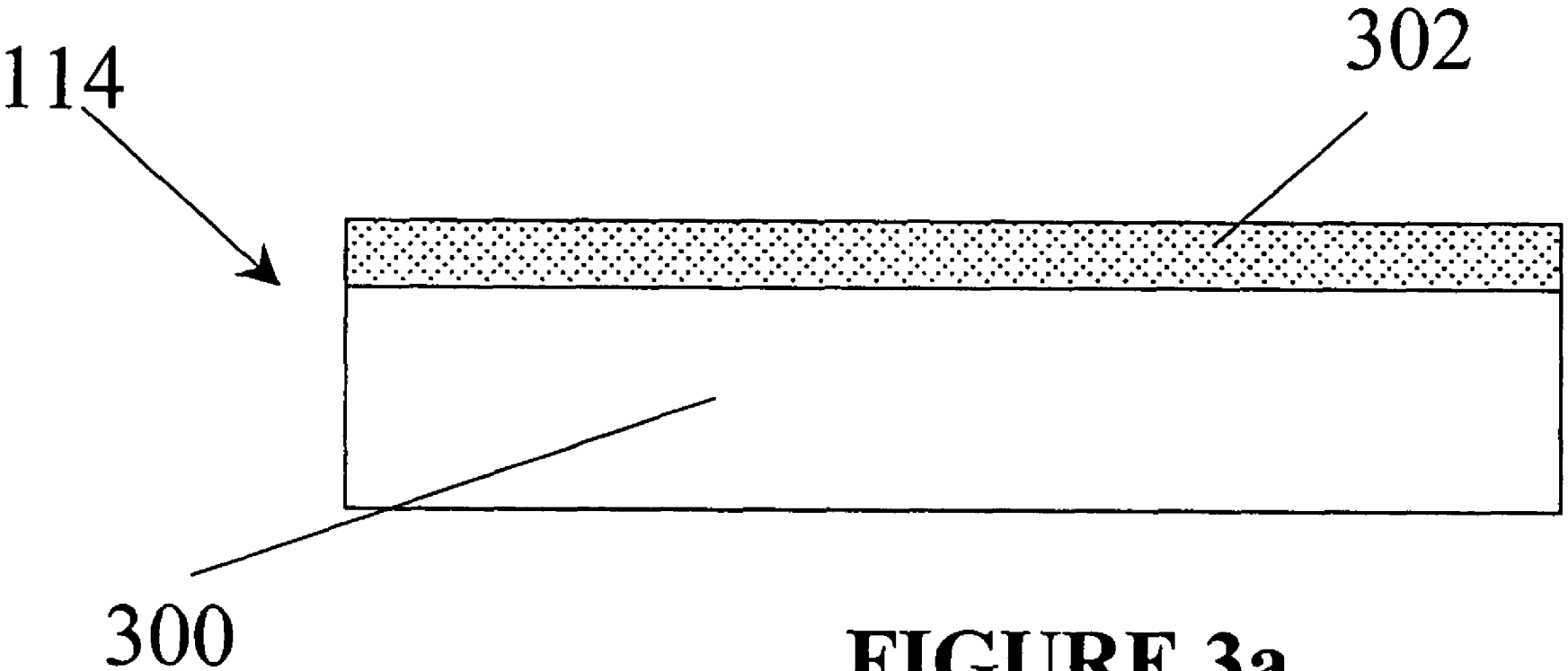
FIG. 3*a* shows a cross-sectional view of the shielding tape of the present invention.
Figure 3B:
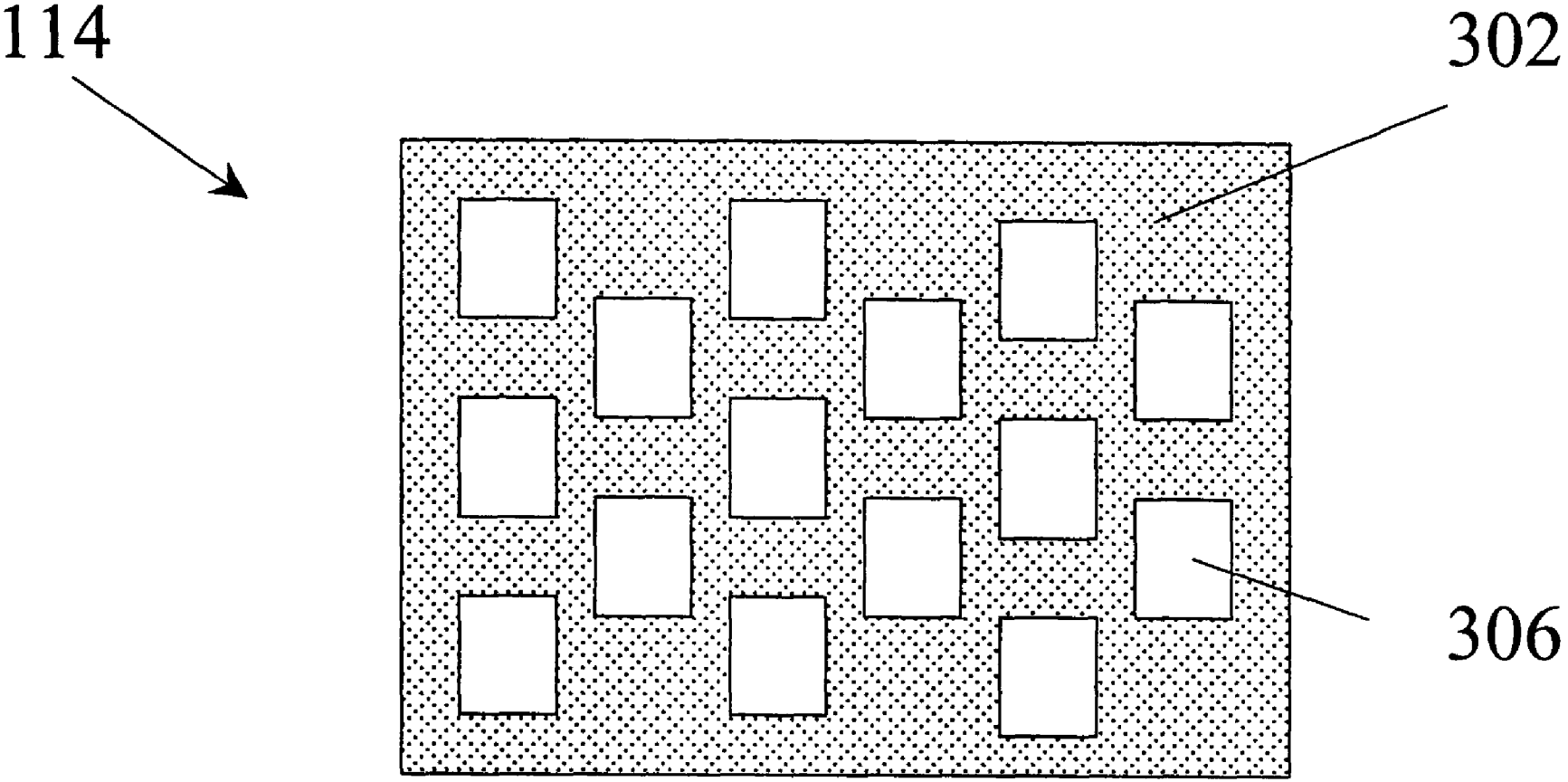
FIG. 3*b* shows a top view of the shielding tape of the present invention.

Referring to FIGS. 3*a* and 3*b*, the shielding tape 114, in accordance with a preferred embodiment of the present invention, includes a metallic sheet 300 coated with an adhesive 302 on the surface of the metallic sheet 300 that faces the insulated conductors 110. The adhesive layer preferably extends over only pre-selected portions of the surface of the metallic sheet 300 so, as shown in FIG. 3*b*, a plurality of spaced contact pads 306 are provided on the coated surface of the tape. The contact pads 306 are uncoated portions of the coated surface where the metal is exposed. When longitudinally wrapped around the core, the adhesive bonds and seals the overlapping edge portions of the tape together, and metal-to-metal contact is effected between the uncoated pads of the metallic layer and the drain wire 122. Further, the adhesive also secures the shielding tapes to the core, thus minimizing one leg of the core sliding in relation to the other when the cable is bent. The shielding tapes disclosed in U.S. Pat. No. 4,746,767 to Gruhn and U.S. Pat. No. 5,008,489 to Weeks, Jr. et al., which are incorporated herein by reference, are suitable for the present invention.

Referring back to FIG. 2, in accordance with a preferred embodiment, surrounding the shielding tape 114 are two layers of polymeric tapes 116 and 118 comprised of a polymeric sheet having an adhesive on one surface thereof to form an adhesive tape. The polymeric tapes 116 and 118 are wrapped spirally around the shielding tape 114, in reverse directions relative to each other. For example, if the first polymeric tape 116 is wrapped in a clockwise direction, the second polymeric tape 118 is wrapped in a counterclockwise direction; and vice versa. The polymeric tapes 116 and 118 are preferably constructed of a plastic, such as Mylar®, a polyester film manufactured by Dupont. Specifically, Mylar® is a biaxially oriented, thermoplastic film made from ethylene glycol and dimethyl terephthalate (DMT). In a preferred embodiment, the tapes are wrapped such that the adhesive coated surfaces face each other to bind the polymeric tapes together. In such preferred embodiment, the interface between the first polymeric tape 116 and the shielding tape 114 contains no adhesive. Besides Mylar®, other polymeric films, such as Kapton®, are also appropriate for the present invention.

The jacket 120, although optional, is preferably composed of a polymeric resin, which can be, but is not limited to, polyvinyl chloride (PVC), polyethylene, polypropylene, copolymer of ethylene and tetrafluoroethylene (ETFE), copolymer of tetrafluoroethylene and hexafluiropropylene (FEP), polytetrafluoroethylene (PTFE) resin, copolymer of tetrafluoroethylene and perfluoroalkoxy (PFA), fluorine-containing rubber, and combinations thereof. The jacket 120 can be extruded around the outer periphery of the polymeric tapes 116 and 118 in a uniform thickness by an extruder, or the like.

Figure 8:
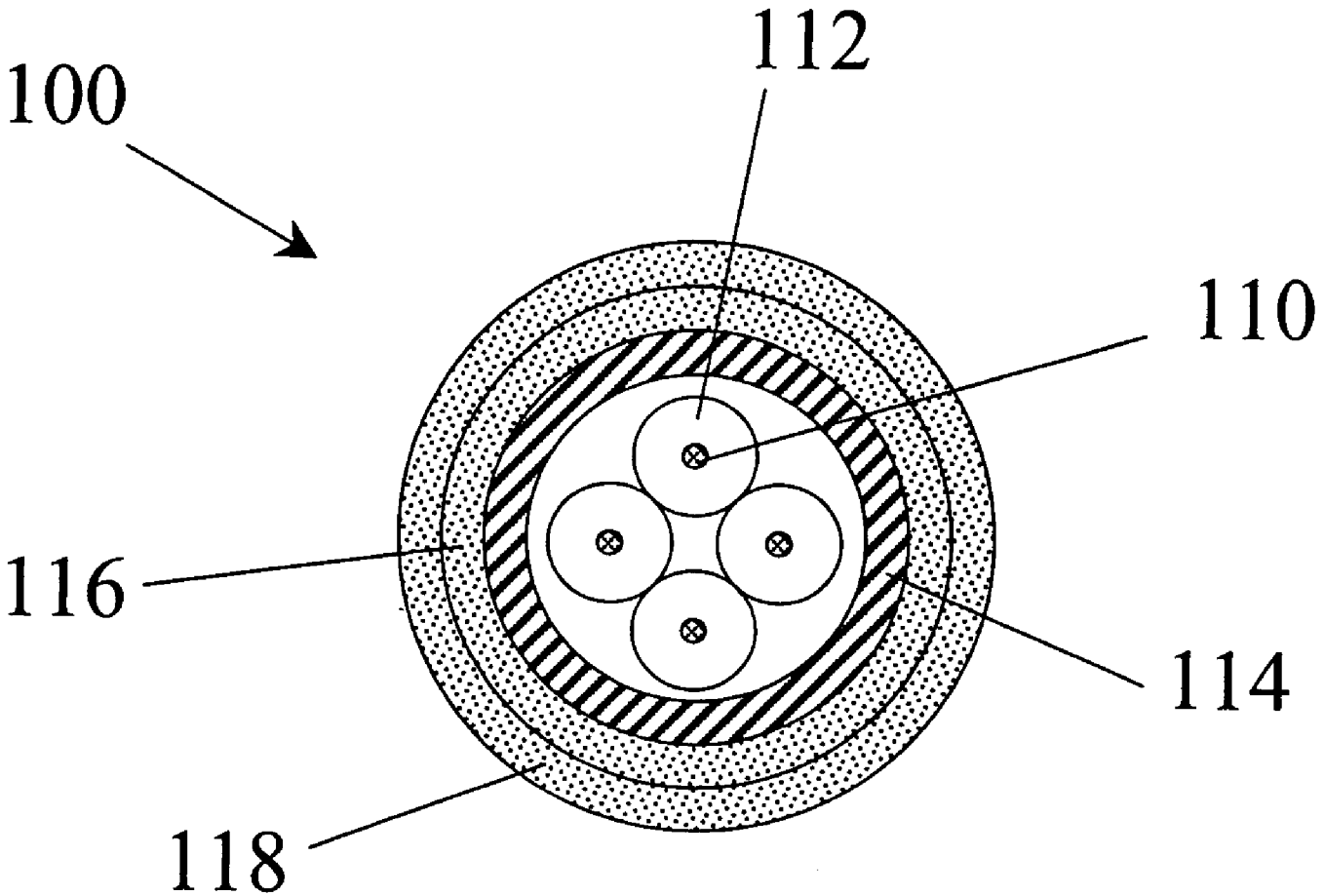
FIG. 8 shows a cross section of a cable having four parallel insulated conductors.

Although FIGS. 1-2 show an embodiment of the present invention where a core simply consists of a pair of parallel wires, more than two parallel wires can be included in a core. For example FIG. 8 shows an embodiment where four parallel insulated conductors 110 constitute a core of a communication cable 100.

Figure 4:
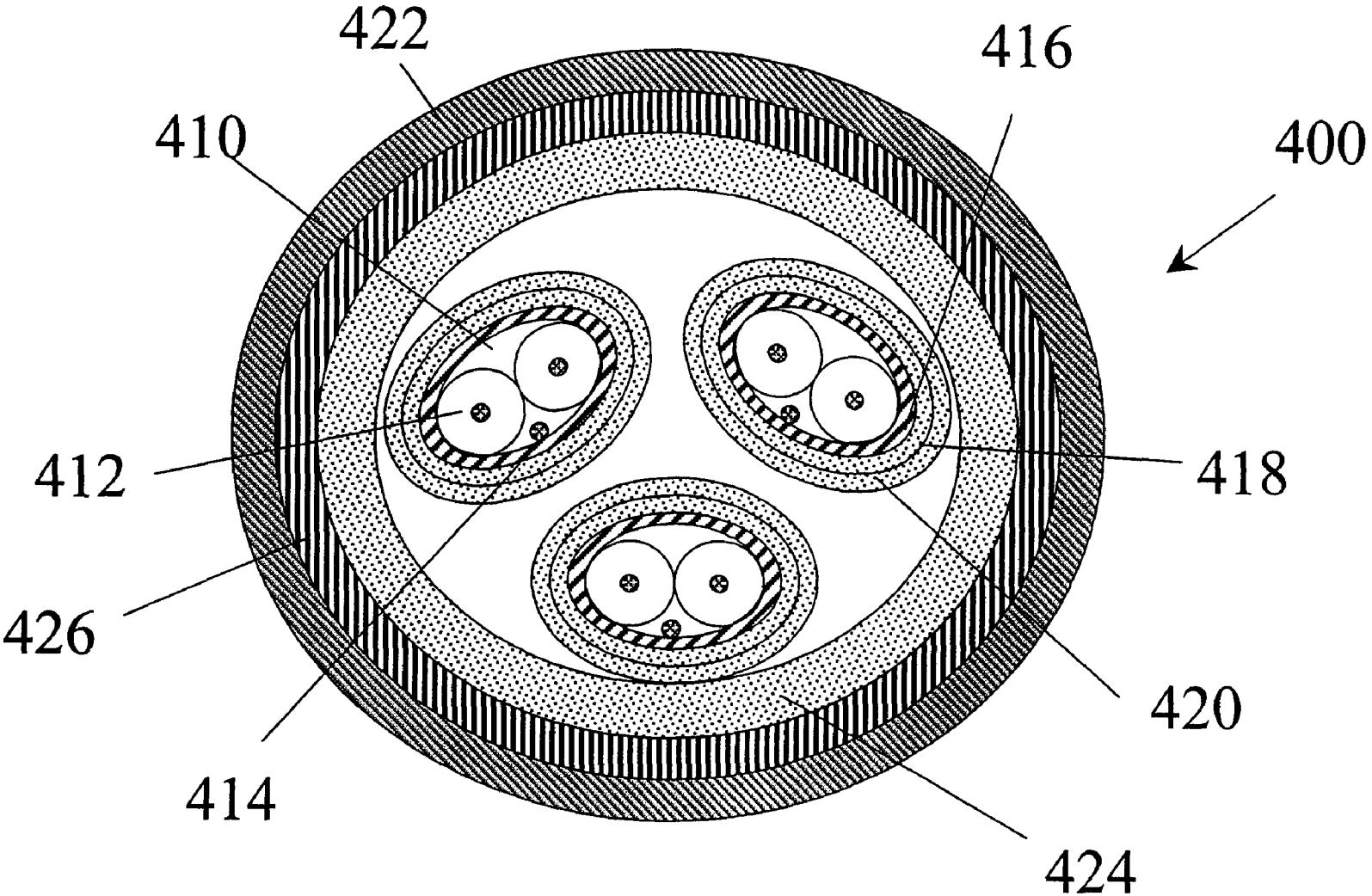
FIG. 4 is a cross-sectional view of an other embodiment of the present invention.

Referring to FIG. 4, in another embodiment of the present invention, a communication cable 400 can include a plurality of cores 410. Each core 410 contains a parallel pair of insulated conductors 412 and a drain wire 414 that are successively covered by a shielding tape 416, and two layers of polymeric tapes 418 and 420. The plurality of cores 410 are then covered with an outer jacket 422. In some embodiments, it may be desirable to wrap the plurality of cores 410 with a binder tape 424, such as a spiral wrapped polyester tape, and/or a secondary shield 426 prior to the jacket 422. In this embodiment, the secondary shield 426 can include a shielding tape and/or a braided shield.

Without further description, it is believed that one of ordinary skill in the art can, using the preceding description and the following illustrative examples, make and utilize the composition of the present invention and practice the methods.

The following example is given to illustrate the present invention. It should be understood that the invention is not to be limited to the specific conditions or details described in this example.

EXAMPLES

Figure 5:
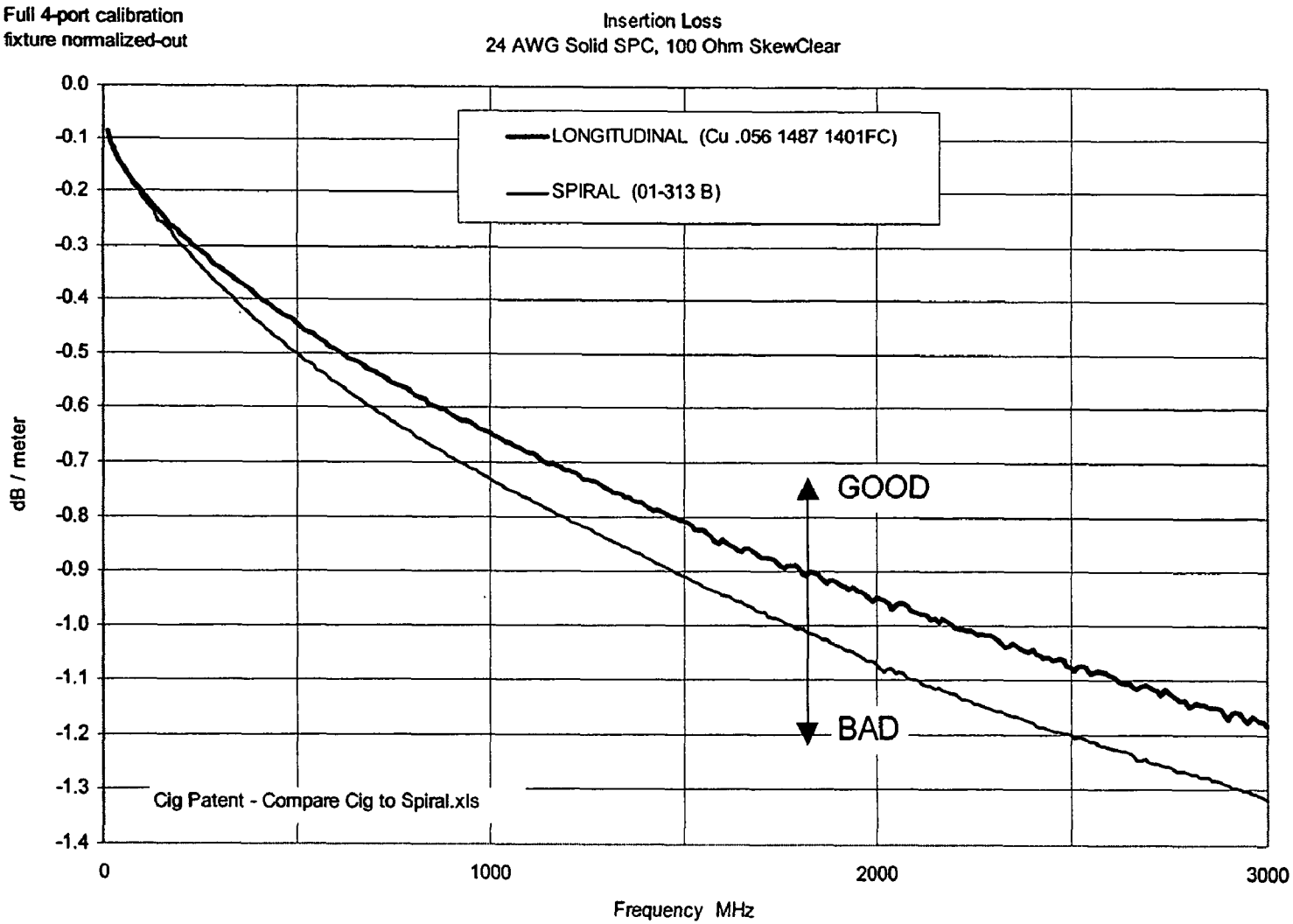
FIG. 5 compares a cable with a longitudinally wrapped shielding tape with a comparable cable with spiral wrapped shielding tape.

The following Examples compare cables of the present invention with other cables. FIG. 5 compares a cable with a longitudinally wrapped shielding tape in accordance with the invention with a comparable cable with spiral wrapped shielding tape. The results clearly show improved attenuation with the longitudinally wrapped shielding tape. Specifically, the longitudinally wrapped cable can be about 13% longer for equal attenuation.

Figure 6:
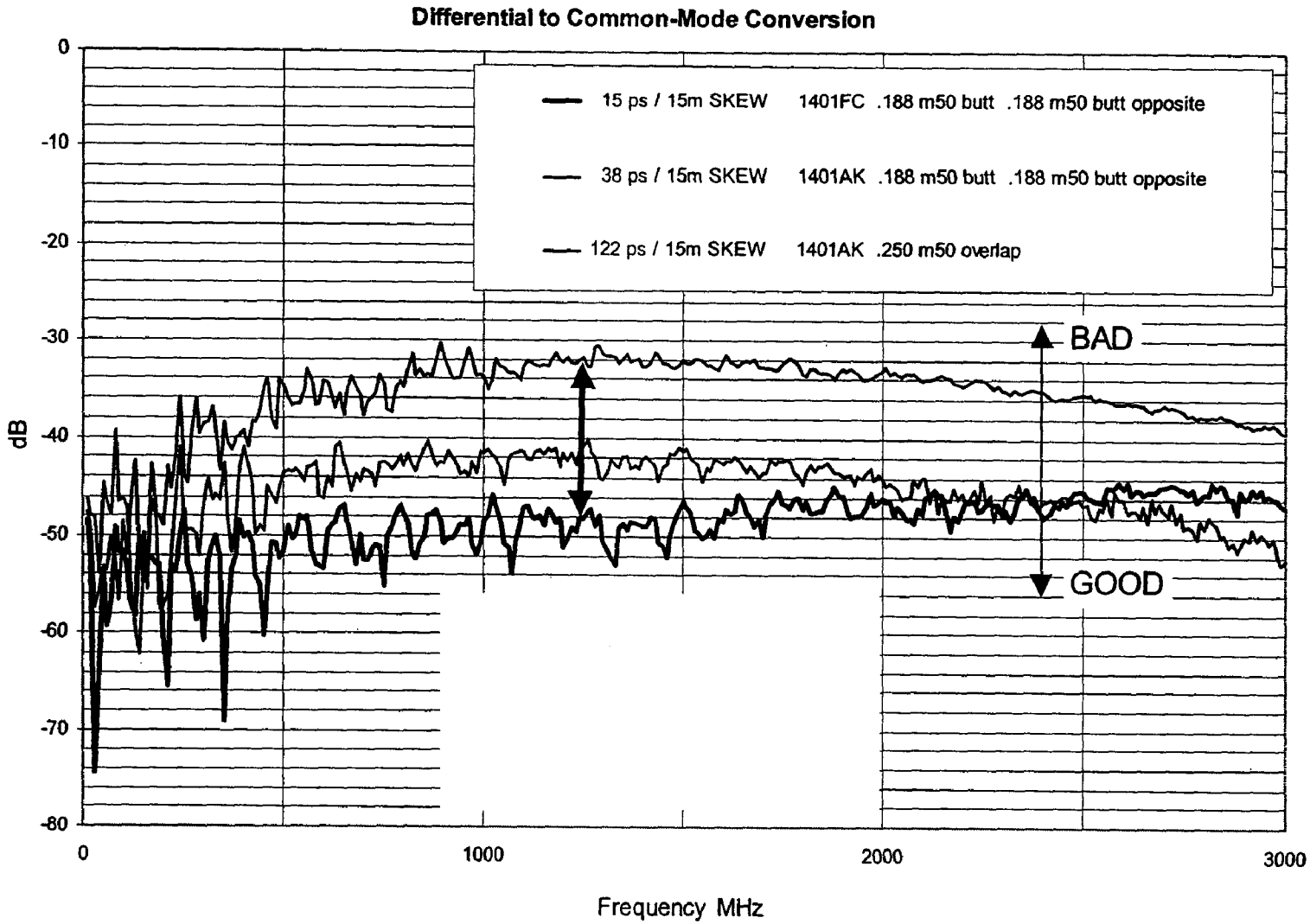
FIG. 6 compares three cables for differential mode to common mode conversion.

FIG. 6 compares three cables for differential mode to common mode conversion. One of the cables contains a single polymeric tape helically wrapped around the shielding tape. Two of the cables contain two polymeric tapes helically wrapped in opposing directions around the shielding tape in accordance with the invention. All three cables contain longitudinally wrapped shielding tapes. The results clearly show that the opposing direction, double wrapped cables have substantially lower skew required to achieve the lowest mode conversion when compared to the single wrapped cable.

Figure 7:
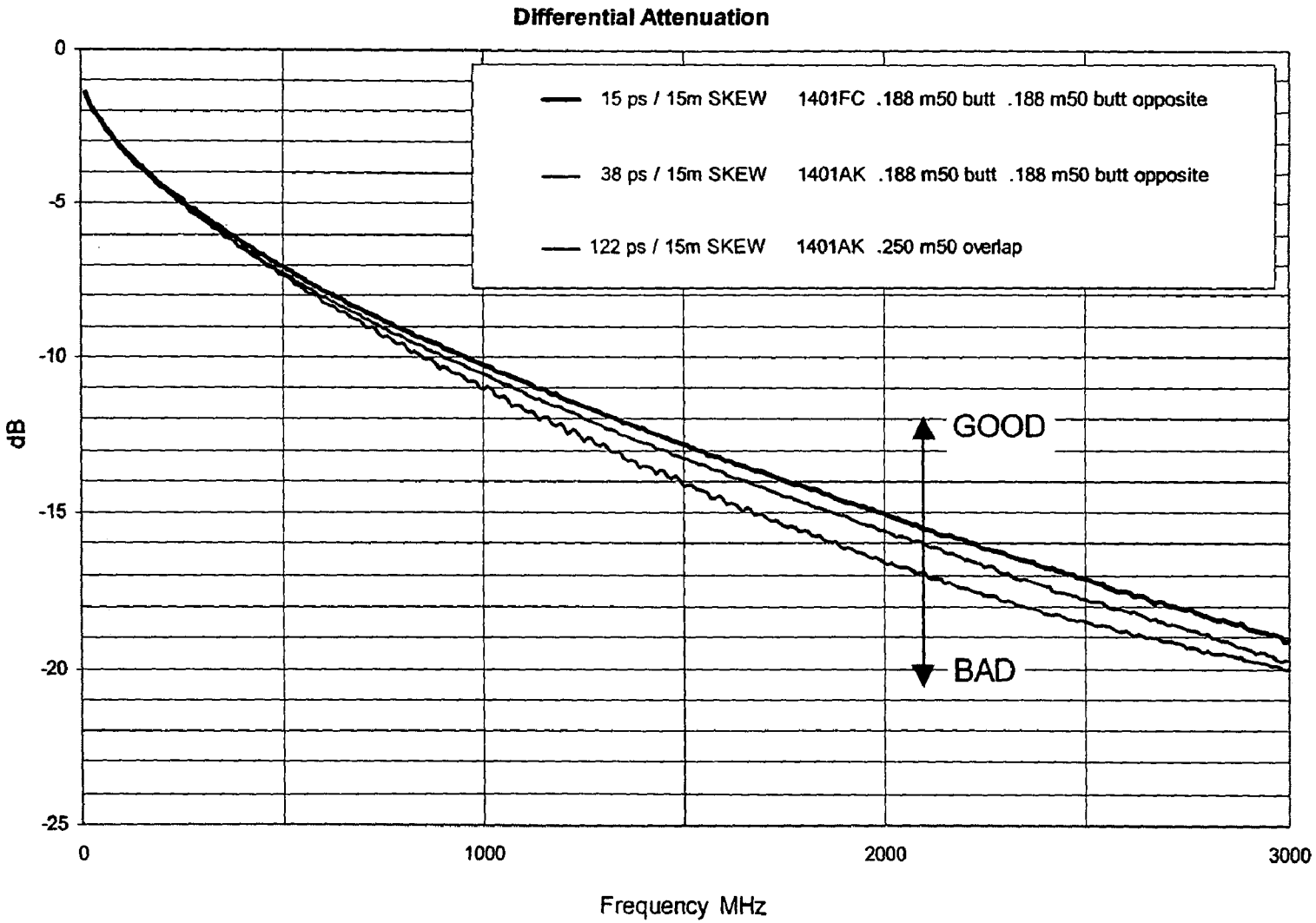
FIG. 7 compares the same three cables for attenuation.

FIG. 7 compares the same three cables for attenuation. The results clearly show that the opposing direction, double wrapped cables contain lower skew required to achieve the best attenuation characteristics when compared to the single wrapped cable.

Overall, the examples show that the cable of the present invention provides superior operational characteristics by achieving low insertion loss performance.

Although certain presently preferred embodiments of the invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A cable for transmitting electrical signals comprising a core consisting of one pair of insulated conductors;

a metal containing shielding tape longitudinally wrapped around the core;

a second tape helically wrapped around the shielding tape; and a third tape helically wrapped around the second tape in the opposite helical direction.

2. The cable of claim 1, wherein the core further having a drain wire.

3. The cable of claim 2, wherein said second and third tapes are polymeric tapes.

4. The cable of claim 3, wherein the polymeric tapes are polyester.

5. The cable of claim 1, wherein each of the second and third tapes contains a polymeric sheet having a layer of adhesive disposed on one surface thereof.

6. The cable of claim 5, wherein the adhesive layers of the first and second tapes face each other.

7. The cable of claim 5, wherein the adhesive layer of the second tape does not face the metal containing shielding tape.

8. The cable of claim 1, wherein the metal containing shielding tape contains a metallic sheet having an adhesive coating applied on selected portions of a surface of the metallic sheet.

9. The cable of claim 8, wherein the uncoated portions of the metallic surface define contact pads that form electrical contact with a drain wire.

10. The cable of claim 8, wherein the metallic sheet is aluminum.

11. The cable of claim 8, wherein the adhesive coating on the metallic sheet is in a checker board pattern.

12. The cable of claim 8, wherein the adhesive coating faces the core.

13. The cable of claim 8, wherein the adhesive faces the second tape.

14. The cable of claim 1, wherein the at least one pair of insulated conductors are in parallel relationship.

15. The cable of claim 1, wherein the second and third tapes being wrapped so as to cover the shielding tape.

16. A method of making a cable for transmitting electrical signals comprising the steps of providing a core consisting of one pair of insulated conductors;

wrapping a metal containing shielding tape longitudinally around the core;

wrapping a second tape helically around the shielding tape; and wrapping a third tape helically around the second tape in the opposite helical direction.

17. The method of claim 16, wherein the core further having a drain wire.

18. The method of claim 17, wherein said second and third tapes are polymeric tapes.

19. The method of claim 18, wherein the polymeric tapes are polyester.

20. The method of claim 16, wherein each of the second and third tapes contains a polymeric sheet having a layer of adhesive disposed on one surface thereof.

21. The method of claim 20, wherein the adhesive layers of the first and second tapes face each other.

22. The method of claim 20, wherein the adhesive layer of the second tape does not face the metal containing shielding tape.

23. The method of claim 16, wherein the metal containing shielding tape contains a metallic sheet having an adhesive coating applied on selected portions of a surface of the metallic sheet.

24. The method of claim 23, wherein the uncoated portions of the metallic surface defines contact pads that form electrical contact with a drain wire.

25. The method of claim 23, wherein the metallic sheet is aluminum.

26. The method of claim 23, wherein the adhesive coating on the metallic sheet is in a checker board pattern.

27. The method of claim 23, wherein the adhesive coating faces the core.

28. The method of claim 23, wherein the adhesive faces the second tape.

29. The method of claim 16, wherein the at least one pair of insulated conductors are in parallel relationship.

30. The method of claim 16, wherein the second and third tapes being wrapped so as to cover the shielding tape.

31. A cable for transmitting electrical signals comprising a plurality of cores, each core consisting of a pair of insulated conductors, and each core is successively covered with a longitudinally wrapped metal containing shielding tape, and two layers of polymeric tapes, wherein the two layers of polymeric tapes are wrapped in opposite helical directions.

32. The cable of claim 31, further comprising a binder tape surrounding the plurality of cores.

33. The cable of claim 32, further comprising a shield surrounding the binder tape.

34. The cable of claim 33, wherein the shield comprises an aluminum-polyester tape and a braided shield.

35. The cable of claim 33, further comprising a jacket surrounding the shield.

36. The cable of claim 31, wherein the two layers of polymeric tapes being wrapped so as to cover the shielding tape.

* * * * *